US009773449B2

(12) United States Patent
Lin et al.

(10) Patent No.: US 9,773,449 B2
(45) Date of Patent: Sep. 26, 2017

(54) PIXEL CIRCUIT WITH ORGANIC LIGHT EMITTING DIODE

(71) Applicant: AU Optronics Corporation, Hsin-Chu (TW)

(72) Inventors: Yung-Ming Lin, Hsin-Chu (TW); Chia-Yuan Yeh, Hsin-Chu (TW)

(73) Assignee: AU OPTRONICS CORP., Hsin-chu (TW)

( * ) Notice: Subject to any disclaimer, the term of this patent is extended or adjusted under 35 U.S.C. 154(b) by 66 days.

(21) Appl. No.: 14/558,777

(22) Filed: Dec. 3, 2014

(65) Prior Publication Data

US 2016/0086536 A1 Mar. 24, 2016

(30) Foreign Application Priority Data

Sep. 24, 2014 (TW) ..... 103133062 A

(51) Int. Cl.
*G09G 3/32* (2016.01)
*G09G 3/3233* (2016.01)

(52) U.S. Cl.
CPC ..... *G09G 3/3233* (2013.01); *G09G 2300/043* (2013.01); *G09G 2300/0814* (2013.01); *G09G 2300/0819* (2013.01); *G09G 2300/0852* (2013.01); *G09G 2300/0861* (2013.01); *G09G 2320/045* (2013.01)

(58) Field of Classification Search
None
See application file for complete search history.

(56) References Cited

U.S. PATENT DOCUMENTS 7,317,435 B2 * 1/2008 Hsueh ..... G09G 3/3233 315/169.1
8,502,757 B2 * 8/2013 Liu ..... G09G 3/3233 345/76
8,743,030 B2 6/2014 Shishido
(Continued)

FOREIGN PATENT DOCUMENTS

CN 101964175 A 2/2011
CN 102142226 B 3/2013
(Continued)

OTHER PUBLICATIONS

English translation of abstract of CN 103150991 (published Jun. 12, 2013).
(Continued)

*Primary Examiner* — Carolyn R. Edwards
*Assistant Examiner* — Bipin Gyawali
(74) *Attorney, Agent, or Firm* — McClure, Qualey & Rodack, LLP

(57) ABSTRACT

A pixel circuit with an organic light emitting diode (OLED) compensates a threshold voltage of the driving switch therein by controlling the connection relationship between a first capacitor and a second capacitor therein. As such, the compensation time of the pixel circuit may be different from the data writing time of the same. Also, the capacitance to be written with the data may be less than that in the conventional technique so that the time needed for the data writing is then reduced and the pixel circuit in the present invention can be used in a display device with a high refresh rate.

33 Claims, 2 Drawing Sheets

(56) References Cited

U.S. PATENT DOCUMENTS

| | | | | |
|---|---|---|---|---|
| 8,902,208 | B2 * | 12/2014 | Chung | G09G 3/3233 345/211 |
| 8,988,400 | B2 | 3/2015 | Shishido | |
| 9,196,196 | B2 * | 11/2015 | Chung | G09G 3/3233 |
| 2007/0035487 | A1 * | 2/2007 | Ryu | G09G 3/3233 345/76 |
| 2007/0085847 | A1 * | 4/2007 | Shishido | G09G 3/3233 345/204 |
| 2010/0141644 | A1 * | 6/2010 | Lee | G09G 3/3233 345/214 |
| 2011/0050741 | A1 * | 3/2011 | Jeong | G09G 3/3233 345/690 |
| 2011/0157135 | A1 | 6/2011 | Lee et al. | |
| 2011/0227885 | A1 * | 9/2011 | Chung | G09G 3/3241 345/204 |
| 2011/0249044 | A1 * | 10/2011 | Ebisuno | G09G 3/3233 345/690 |
| 2012/0162275 | A1 | 6/2012 | Park | |
| 2013/0194248 | A1 * | 8/2013 | Kim | G09G 3/3233 345/212 |

FOREIGN PATENT DOCUMENTS

| | | |
|---|---|---|
| CN | 103150991 | 6/2013 |
| CN | 103745690 | 4/2014 |

OTHER PUBLICATIONS

English translation of abstract of CN 103745690 (published Apr. 23, 2014).

Office Action issued in corresponding Chinese patent application (No. 101401690897.5) on Jul. 19, 2016.

* cited by examiner

PIXEL CIRCUIT WITH ORGANIC LIGHT EMITTING DIODE

CROSS-REFERENCE TO RELATED APPLICATIONS

This non-provisional application claims priority under 35 U.S.C. §119(a) on Patent Application No(s). 103133062 filed in Taiwan, R.O.C. on Sep. 24, 2014, the entire contents of which are hereby incorporated by reference.

TECHNICAL FIELD

The disclosure relates to a pixel circuit with an organic light emitting diode (OLED), more particularly to a pixel circuit with an OLED, which is capable of compensating threshold voltages.

BACKGROUND

Organic light emitting diodes (OLED) have a smaller size and a high luminous efficiency and can be applied to flexible panels such that they can be backlight components or pixels in a display device. The OLEDs as pixels in the display device generally use the thin-film transistor (TFT) fabrication. Transistor switches made by the TFT fabrication have a greater difference in threshold voltage ($V_{th}$) therebetween than transistor switches made by general fabrications. Moreover, the threshold voltages of the transistor switches made by the TFT fabrication will change with the usage time. In other words, even if two TFT switches have the same threshold voltage during manufacturing, the threshold voltages of the two TFT switches will change with the usage time variously, resulting in the difference in threshold voltage between the two TFT switches.

Because the threshold voltages of the transistors in the pixel circuit of two adjacent or close pixels in the display device become different, even when the driving chip in the display device supplies the same data voltage to the two pixels to make them show the same color in an image frame, the colors shown by the two pixels become different from each other. For example, the intensity of red light emitted by the left pixel is greater than the intensity of red light emitted by the right pixel. Furthermore, when the display device has been used for a period of time, colors of the image frame displayed by the display device would be aberrant because of the change of the threshold voltages of the transistors in the OLED. Therefore, the change of threshold voltage causes such unwanted effect to the display device.

SUMMARY

According to one or more embodiments, the disclosure provides a pixel circuit. In one embodiment, the pixel circuit includes an OLED, a driving switch, an enabling switch, a first capacitor, a second capacitor, and a compensation module. A first terminal of the OLED receives a first reference voltage. A first terminal of the driving switch receives a second reference voltage, and a control terminal of the driving switch provides a driving current according to a driving voltage. Two terminals of the enabling switch are electrically connected to a second terminal of the driving switch and a second terminal of the OLED respectively. A first terminal of the first capacitor is electrically connected to the control terminal of the driving switch, and a second terminal of the first capacitor receives a third reference voltage. A first terminal of the second capacitor is electrically connected to the control terminal of the driving switch. The OLED is driven by the driving current. The enabling switch is off during a first time period in a working period but is on a second time period following the first time period in the working period. The compensation module provides a third reference voltage to the control terminal of the driving switch during a third time period in the first time period, electrically connects the control terminal of the driving switch to the second terminal of the driving switch during a fourth time period following the third time period in the first time period, provides a data voltage to the second terminal of the second capacitor during a fifth time period following the third time period in the first time period, and makes the second terminal of the second capacitor receive the third reference voltage during the second time period.

BRIEF DESCRIPTION OF THE DRAWINGS

The present disclosure will become more fully understood from the detailed description given herein below for illustration only and thus does not limit the present disclosure, wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
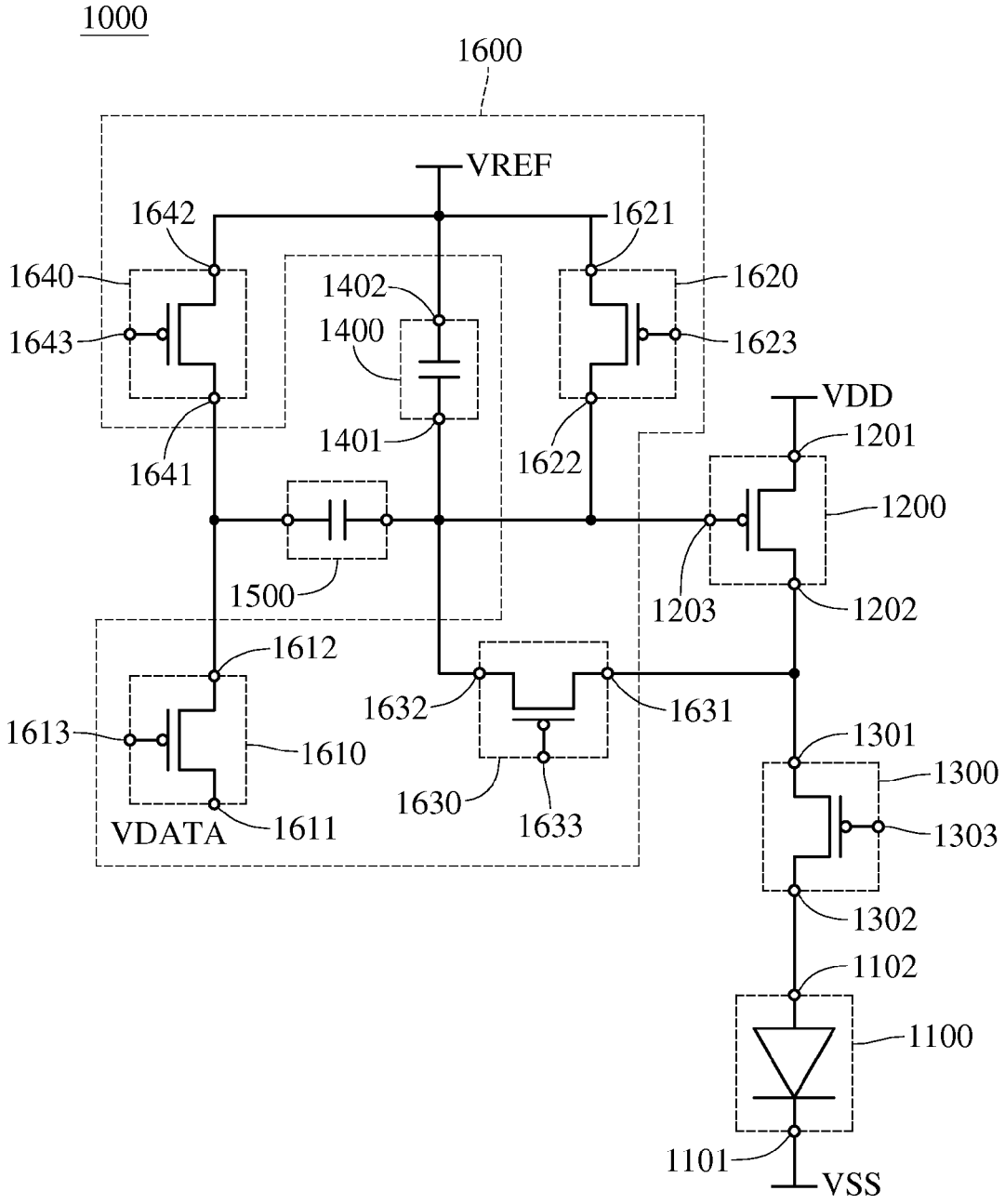
FIG. 1 is a schematic diagram of an embodiment of a pixel circuit in the disclosure.

FIG. 1 is a schematic diagram of an embodiment of a pixel circuit in the disclosure. A pixel circuit 1000 includes an OLED 1100, a driving switch 1200, an enabling switch 1300, a first capacitor 1400, a second capacitor 1500, and a compensation module 1600. A first terminal 1101 of the OLED 1100 receives a first reference voltage VSS. A first terminal 1201 of the driving switch 1200 receives a second reference voltage VDD. The second reference voltage VDD is higher than the first reference voltage VSS.

Two terminals of the enabling switch 1300 are electrically connected to a second terminal 1202 of the driving switch 1200 and a second terminal 1102 of the OLED 1100 respectively. Particularly, the enabling switch 1300 has a first terminal 1301, a second terminal 1302, and a control terminal 1303. The first terminal 1301 of the enabling switch 1300 is electrically connected to the second terminal 1202 of the driving switch 1200, and the second terminal 1302 of the enabling switch 1300 is electrically connected to the second terminal 1102 of the OLED 1100. The control terminal 1303 of the enabling switch 1300 is controlled by an enabling signal VEN to determine whether the first terminal 1301 of the enabling switch 1300 is electrically connected to the second terminal 1302 of the enabling switch 1300.

A first terminal 1401 of the first capacitor 1400 is electrically connected to the control terminal 1203 of the driving switch 1200, a second terminal 1402 of the first capacitor 1400 receives a third reference voltage VREF. For example, the third reference voltage VREF is lower than the second reference voltage VDD. Alternately, the third reference voltage VREF can be replaced by the first reference voltage VSS. A first terminal of the second capacitor 1500 is electrically connected to the control terminal 1203 of the driving switch 1200. In the disclosure, all switches are carried out by N-type transistors or P-type transistors. The following embodiments will use P-type transistors to carry out all switches for the illustration purpose.

The OLED 1100 is driven by a driving current ID. Specifically, the luminous intensity of the OLED 1100 is proportional to the driving current ID. The driving switch 1200 provides the driving current ID according to the driving voltage VD on the control terminal 1203. Particularly, the driving current ID is related to the driving voltage VD and the second reference voltage VDD and is modeled as:

$$ID=K(VDD-VD-|VTH|)^2 \quad (1)$$

where the characteristic coefficient K of the driving switch 1200 is related to the manufacture process and the size of the driving switch 1200, and VTH represents the threshold voltage of the driving switch 1200.

The compensation module 1600 provides a third reference voltage VREF to the control terminal 1203 of the driving switch 1200 during the third time period P3 in the first time period P1 such that the driving voltage VD is equal to the third reference voltage VREF during the third time period P3. The compensation module 1600 further electrically connects the control terminal 1203 of the driving switch 1200 to the second terminal 1202 of the driving switch 1200 during the fourth time period P4 following the third time period P3 in the first time period P1 whereby the driving switch 1200 herein is considered as a diode-connected switch. Next, the second terminal of the second capacitor 1500 provides a data voltage VDATA during a fifth time period P5 following the third time period P3 in the first time period P1 and receives the third reference voltage VREF during a second time period P2. The fifth time period P5 ends earlier than the fourth time period P4.

As shown in FIG. 1, the compensation module 1600 includes a data switch 1610, a first switch 1620, a second switch 1630, and a third switch 1640. A first terminal 1611 of the data switch 1610 is electrically connected to an external device in order to receive the data voltage VDATA, a second terminal 1612 of the data switch 1610 is electrically connected to the second terminal of the second capacitor 1500, and the control terminal 1613 of the data switch 1610 receives a data reading signal SDATA. Therefore, the electrical connection between the first terminal 1611 and second terminal 1612 of the data switch 1610 is enabled according to the voltage level of the data reading signal SDATA.

In this or some embodiments, the external device adjusts the data voltage VDATA to be equal to the voltage supplied to the pixel circuit 1000 during a sixth time period P6. The starting point of the sixth time period P6 is earlier than the starting point of the fifth time period P5, and the end point of the sixth time period P6 is later than the end point of the fifth time period P5. Furthermore, the pixel circuit 1000 is one of pixel circuits in the display device so the sixth time period P6 is equal to a line time of the display device.

The first switch 1620 has two terminals, one of the two terminals of the first switch 1620 receives the third reference voltage VREF, and the other one of the two terminals of the first switch 1620 is electrically connected to the control terminal 1203 of the driving switch 1200. Specifically, a first terminal 1621 of the first switch 1620 receives the third reference voltage VREF, a second terminal 1622 of the first switch 1620 is electrically connected to the control terminal 1203 of the driving switch 1200, and a control terminal 1623 of the first switch 1620 receives a first switch signal S1. Therefore, the electrical connection between the first terminal 1621 and second terminal 1622 of the first switch 1620 is enabled according to the first switch signal S1.

The second switch 1630 has two terminals electrically connected to the second terminal 1202 of the driving switch 1200 and the control terminal 1203 of the driving switch 1200. In practice, a first terminal 1631 of the second switch 1630 is electrically connected to the second terminal 1202 of the driving switch 1200, a second terminal 1632 of the second switch 1630 is electrically connected to the control terminal 1203 of the driving switch 1200, and a control terminal 1633 of the second switch 1630 receives a second switch signal S2. Therefore, the electrical connection between the first terminal 1631 and second terminal 1632 of the second switch 1630 is enabled according to the second switch signal S2.

The third switch 1640 has two terminals, one of the two terminals of the third switch 1640 is electrically connected to the second terminal 1612 of the data switch 1610, and the other one of the two terminals of the third switch 1640 receives the third reference voltage VREF. Particularly, a first terminal 1641 of the third switch 1640 is electrically connected to the second terminal 1612 of the data switch 1610, a second terminal 1642 of the third switch 1640 receives the third reference voltage VREF, and a control terminal 1643 of the third switch 1640 receives an enabling signal VEN. Accordingly, the electrical connection between the first terminal 1641 and second terminal 1642 of the third switch 1640 is enabled according to the enabling signal VEN.

Figure 2:
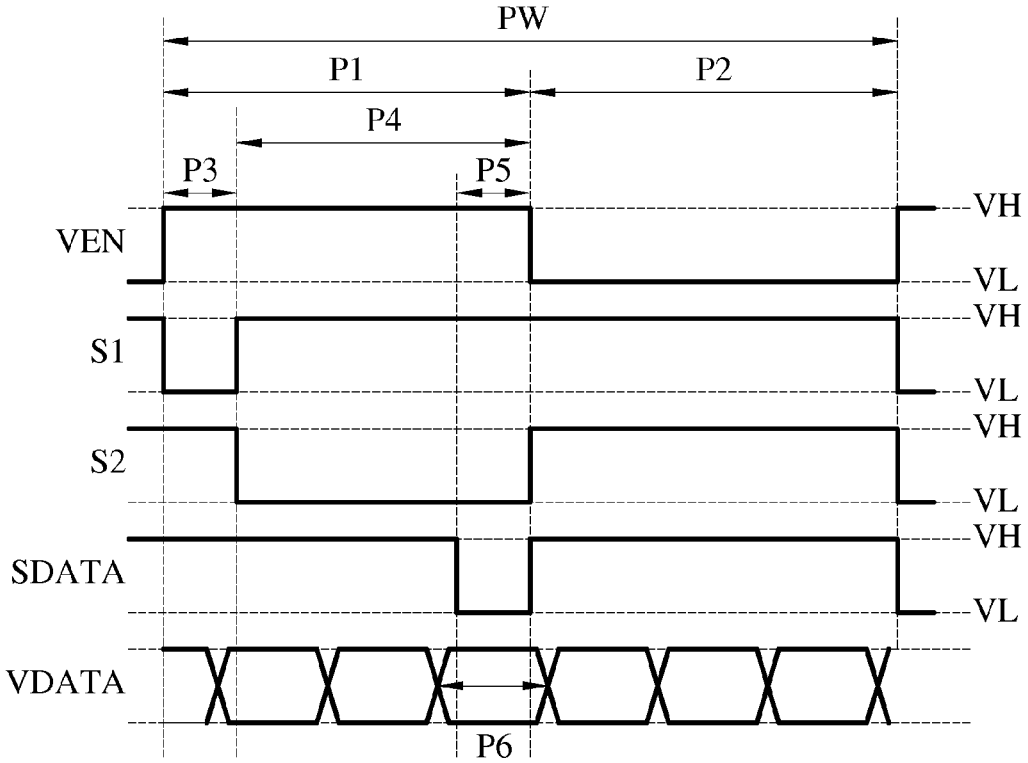
FIG. 2 is a time sequence diagram of the pixel circuit in FIG. 1 according to an embodiment in the disclosure.

FIG. 2 is a time sequence diagram of the pixel circuit in FIG. 1 according to an embodiment in the disclosure. During the first time period P1 in a working period PW, the enabling signal VEN is at a high voltage level VH, and during the second time period P2 in the working period PW, the enabling signal VEN is at a low voltage level VL. Thus, the enabling switch 1300 and the third switch 1640 are off during the first time period P1 in the working period PW but are on during the second time period P2 following the first time period P1. During the fifth time period P5, the data reading signal SDATA is at the low voltage level VL but during the working period PW except the fifth time period P5, is at the high voltage level VH. Therefore, the data switch 1610 is on during the fifth time period P5 but is off during the working period PW except the fifth time period P5. Moreover, the first switch signal S1 is at the low voltage level VL during the third time period P3 but is at the high voltage level VH during the working period PW except the third time period P3. Therefore, the first switch 1620 is on during the third time period P3 but is off during the working period PW except the third time period P3. The second switch signal S2 is at the low voltage level VL during the fourth time period P4 but is at the high voltage level VH during the working period PW except the fourth time period P4, whereby the second switch 1630 is on during the fourth time period P4 but is off during the working period PW except the fourth time period P4.

Accordingly, since the first switch 1620 is on during the third time period P3, the driving voltage VD will be adjusted to be equal to the third reference voltage VREF. Because the third reference voltage VREF is much lower than the second reference voltage VDD, the driving switch 1200 will become a diode-connected switch when the second switch 1630 is on during the fourth time period P4. Therefore, the driving voltage VD increases to be equal to the second reference voltage VDD minus the threshold voltage VTH of the driving switch 1200 during the fourth time period P4, and after the end point of the fourth time period P4, the difference V2 between the first terminal 1401 and second terminal 1042 of the first capacitor 1400 can be presented by:

$$V2=V\text{REF}-VDD+|VTH| \quad (2)$$

Moreover, the data switch 1610 is on during the fifth time period P5 so the voltage on the second terminal of the second capacitor 1500 is adjusted to be equal to the data voltage VDATA. Then, after the end point of the fifth time period P5, the difference V1 between two terminals of the second capacitor 1500 can be modeled as:

$$V1=V\text{DATA}-VDD+|VTH|. \quad (3)$$

Subsequently, because the third switch 1640 is on during the second time period P2, the first capacitor 1400 and the second capacitor 1500 are connected in parallel, whereby the difference Vtot between the two terminals of both of the first capacitor 1400 and the second capacitor 1500 can be modeled as:

$$Vtot=(C1\times V\text{REF}+C2\times V\text{DATA})/(C1+C2)-VDD+|VTH|, \quad (4)$$

where C1 represents the capacitance value of the first capacitor 1400, and C2 represents the capacitance value of the second capacitor 1500. The driving voltage VD can be modeled as:

$$VD=(V\text{REF}-V\text{DATA})C2/(C1+C2)+VDD-|VTH|. \quad (5)$$

Therefore, the driving current ID to drive the OLED 1100 during the second time period P2 can be modeled as:

$$ID=K[(V\text{REF}-V\text{DATA})C2/(C1+C2)]^2. \quad (6)$$

In view of the equation (6), the threshold voltage VTH of the driving switch 1200 does not matter the driving current ID such that the pixel circuit 1000 is capable of compensating the threshold voltage.

In other embodiments, the data switch signal SDATA can be replaced by the second switch signal S2, and then the external control signal can decrease. In other embodiment, the end point of the fourth time period P4 and the end point of the fifth time period P5 are synchronous, that is, the data switch signal SDATA and the second switch signal S2 simultaneously change from the low voltage level VL to the high voltage level. Herein, the driving switch 1200 functions as a transistor such that the time spent on compensating threshold voltages is longer than the time spent on writing the data voltage. In other embodiment, a ratio of the capacitance value of the first capacitor 1400 to the capacitance value of the second capacitor 1500 is M/N, where M and N are positive integers. In other embodiment, the capacitance values of the first capacitor 1400 and the second capacitor 1500 are the same. The first capacitor 1400 can be carried out by first sub-capacitors arranged around a common centroid, and the second capacitor 1500 can be carried out by second sub-capacitors arranged around a common centroid. Each first sub-capacitor and each second sub-capacitor have the same capacitance value.

In other embodiments, when all switches are carried out by N transistors, the first reference voltage VSS and the third reference voltage VREF are higher than the second reference voltage VDD. During other time periods, the switching on/off of each switch can be referred to the aforementioned description as the voltage level of each switch signal needs to be adjusted.

As set forth above, the pixel circuit in the disclosure adds the second capacitor and arranges the electrical connection between the first capacitor and the second capacitor to compensate the threshold voltage of the driving switch. In this way, the compensation time is different from the writing time for the data voltage, and the capacitor holding the data voltage is smaller than a capacitor used in the conventional compensation technology. Therefore, the time spent on writing the data voltage decreases, and the pixel circuit can be applied to a display device with a higher refresh rate.

What is claimed is:

1. A pixel circuit, comprising:

an organic light emitting diode (OLED) having a first terminal and a second terminal, the first terminal of the OLED receiving a first reference voltage, and the OLED being driven by a driving current;

a driving switch having a first terminal, a second terminal, and a control terminal, the first terminal of the driving switch receiving a second reference voltage, and the control terminal of the driving switch being controlled by a driving voltage to provide the driving current;

an enabling switch having two terminals which electrically connect to the second terminal of the driving switch and the second terminal of the OLED respectively, and configured to be off during an entire first time period in a working period and be on during an entire second time period following the first time period in the working period;

a first capacitor having a first terminal and a second terminal, the first terminal of the first capacitor electrically connecting to the control terminal of the driving switch, and the second terminal of the first capacitor receiving a third reference voltage;

a second capacitor having a first terminal and a second terminal, and the first terminal of the second capacitor electrically connecting to the control terminal of the driving switch; and a compensation module, configured to supply the third reference voltage to the control terminal of the driving switch during an entire third time period in the first time period, electrically connect the control terminal of the driving switch to the second terminal of the driving switch during an entire fourth time period following the third time period in the first time period, supply a data voltage to the second terminal of the second capacitor during an entire fifth time period following the third time period in the first time period, and make the second terminal of the second capacitor receive the third reference voltage during the entire second time period;

wherein the fifth time period partially overlaps and is shorter than the fourth time period.

2. The pixel circuit according to claim 1, wherein the compensation module comprising:

a data switch having a first terminal and a second terminal, the first terminal of the data switch receiving the data voltage, the second terminal of the data switch electrically connecting to the second terminal of the second capacitor, the data switch being turned on during the entire fifth time period and being turned off during the working period except the fifth time period;

a first switch having two terminals that receive the third reference voltage and are electrically connected to the control terminal of the driving switch respectively, and configured to be on during the entire third time period and be off during the working period except the third time period;

a second switch having two terminals that are electrically connected to the second terminal of the driving switch and the control terminal of the driving switch respectively, and configured to be on during the entire fourth time period and be off during the working period except the fourth time period; and a third switch having two terminals that are electrically connected to the second terminal of the data switch and receive the third reference voltage respectively, and configured to be on during the entire second time period.

3. The pixel circuit according to claim 2, wherein the first reference voltage is equal to the third reference voltage.

4. The pixel circuit according to claim 2, wherein the fourth time period is longer than or equal to the fifth time period.

5. The pixel circuit according to claim 4, wherein the fourth time period and the fifth time period end synchronously.

6. The pixel circuit according to claim 2, wherein a ratio of a capacitance value of the first capacitor to a capacitance value of the second capacitor is a natural number.

7. The pixel circuit according to claim 6, wherein the capacitance value of the first capacitor is equal to the capacitance value of the second capacitor.

8. The pixel circuit according to claim 6, wherein the first capacitor comprises first sub-capacitors, the second capacitor comprises second sub-capacitors, and the first sub-capacitor and the second sub-capacitors are arranged around a common centroid.

9. The pixel circuit according to claim 1, wherein the driving switch and the enabling switch are P type transistors, and the first reference voltage and the third reference voltage are lower than the second reference voltage.

10. The pixel circuit according to claim 9, wherein the first reference voltage is equal to the third reference voltage.

11. The pixel circuit according to claim 9, wherein the fourth time period is longer than or equal to the fifth time period.

12. The pixel circuit according to claim 11, wherein the fourth time period and the fifth time period end synchronously.

13. The pixel circuit according to claim 9, wherein a ratio of a capacitance value of the first capacitor to a capacitance value of the second capacitor is a natural number.

14. The pixel circuit according to claim 13, wherein the capacitance value of the first capacitor is equal to the capacitance value of the second capacitor.

15. The pixel circuit according to claim 13, wherein the first capacitor comprises first sub-capacitors, the second capacitor comprises second sub-capacitors, and the first sub-capacitor and the second sub-capacitors are arranged around a common centroid.

16. The pixel circuit according to claim 1, wherein the driving switch and the enabling switch are N type transistors, and the first reference voltage and the third reference voltage are lower than the second reference voltage.

17. The pixel circuit according to claim 16, wherein the first reference voltage is equal to the third reference voltage.

18. The pixel circuit according to claim 16, wherein the fourth time period is longer than or equal to the fifth time period.

19. The pixel circuit according to claim 18, wherein the fourth time period and the fifth time period end simultaneously.

20. The pixel circuit according to claim 16, wherein a ratio of a capacitance value of the first capacitor to a capacitance value of the second capacitor is a natural number.

21. The pixel circuit according to claim 20, wherein the capacitance value of the first capacitor is equal to the capacitance value of the second capacitor.

22. The pixel circuit according to claim 20, wherein the first capacitor comprises first sub-capacitors, the second capacitor comprises second sub-capacitors, and the first sub-capacitor and the second sub-capacitors are arranged around a common centroid.

23. The pixel circuit according to claim 1, wherein the first reference voltage is equal to the third reference voltage.

24. The pixel circuit according to claim 1, wherein the fourth time period is longer than or equal to the fifth time period.

25. The pixel circuit according to claim 24, wherein the fourth time period and the fifth time period end simultaneously.

26. The pixel circuit according to claim 1, wherein a ratio of a capacitance value of the first capacitor to a capacitance value of the second capacitor is a natural number.

27. The pixel circuit according to claim 26, wherein the capacitance value of the first capacitor is equal to the capacitance value of the second capacitor.

28. The pixel circuit according to claim 26, wherein the first capacitor comprises first sub-capacitors, the second capacitor comprises second sub-capacitors, and the first sub-capacitor and the second sub-capacitors are arranged around a common centroid.

29. A pixel circuit, comprising:

an organic light emitting diode (OLED) having a first terminal and a second terminal, the first terminal of the OLED receiving a first reference voltage, and the OLED being driven by a driving current;

a driving switch having a first terminal, a second terminal, and a control terminal, the first terminal of the driving switch receiving a second reference voltage, and the control terminal of the driving switch being controlled by a driving voltage to provide the driving current;

an enabling switch having two terminals which electrically connect to the second terminal of the driving switch and the second terminal of the OLED respectively, and configured to be off during an entire first time period in a working period and be on during an entire second time period following the first time period in the working period;

a first capacitor having a first terminal and a second terminal, the first terminal of the first capacitor electrically connecting to the control terminal of the driving switch, and the second terminal of the first capacitor receiving a third reference voltage;

a second capacitor having a first terminal and a second terminal, and the first terminal of the second capacitor electrically connecting to the control terminal of the driving switch; and a compensation module, configured to supply the third reference voltage to the control terminal of the driving switch during an entire third time period in the first time period, electrically connect the control terminal of the driving switch to the second terminal of the driving switch during an entire fourth time period following the third time period in the first time period, supply a data voltage to the second terminal of the second capacitor during an entire fifth time period following the third time period in the first time period, and make the second terminal of the second capacitor receive the third reference voltage during the entire second time period;

wherein the fifth time period partially overlaps and is shorter than the fourth time period; and when the OLED emits light during the second time period, the second terminal of the first capacitor is electrically connected to the second terminal of the second capacitor.

30. The pixel circuit according to claim 29, wherein the compensation module comprising:

a data switch having a first terminal and a second terminal, the first terminal of the data switch receiving the data voltage, the second terminal of the data switch electrically connecting to the second terminal of the second capacitor, the data switch being turned on during the entire fifth time period and being turned off during the working period except the fifth time period;

a first switch having two terminals that receive the third reference voltage and are electrically connected to the control terminal of the driving switch respectively, and configured to be on during the entire third time period and be off during the working period except the third time period;

a second switch having two terminals that are electrically connected to the second terminal of the driving switch and the control terminal of the driving switch respectively, and configured to be on during the entire fourth time period and be off during the working period except the fourth time period; and a third switch having two terminals that are electrically connected to the second terminal of the data switch and receive the third reference voltage respectively, and configured to be on during the entire second time period.

31. The pixel circuit according to claim 30, wherein the capacitance value of the first capacitor is equal to the capacitance value of the second capacitor.

32. The pixel circuit according to claim 30, wherein the first capacitor comprises first sub-capacitors, the second capacitor comprises second sub-capacitors, and the first sub-capacitor and the second sub-capacitors are arranged around a common centroid.

33. The pixel circuit according to claim 29, wherein the driving switch and the enabling switch are P type transistors, and the first reference voltage and the third reference voltage are lower than the second reference voltage.

* * * * *